US012144413B2

(12) United States Patent
McCarthy et al.

(10) Patent No.: US 12,144,413 B2
(45) Date of Patent: Nov. 19, 2024

(54) EXERCISE ARTICLE FOR CARRYING A WEIGHTED PLATE

(71) Applicant: GORUCK Holdings, LLC, Jacksonville Beach, FL (US)

(72) Inventors: Jason Jerome McCarthy, Atlantic Beach, FL (US); Christian Sbailo, Jacksonville Beach, FL (US); Spencer Metzler, Lima, MT (US)

(73) Assignee: GORUCK Holdings, LLC, Jacksonville Beach, FL (US)

( * ) Notice: Subject to any disclaimer, the term of this patent is extended or adjusted under 35 U.S.C. 154(b) by 0 days.

(21) Appl. No.: 17/738,705

(22) Filed: May 6, 2022

(65) Prior Publication Data

US 2022/0354239 A1 Nov. 10, 2022

Related U.S. Application Data

(60) Provisional application No. 63/185,114, filed on May 6, 2021.

(51) Int. Cl.
*A45F 3/04* (2006.01)
*A63B 21/065* (2006.01)

(52) U.S. Cl.
CPC ..... *A45F 3/04* (2013.01); *A63B 21/065* (2013.01)

(58) Field of Classification Search
CPC ..... A63B 21/065; A45F 3/04
USPC ..... 482/105
See application file for complete search history.

(56) References Cited

U.S. PATENT DOCUMENTS

| | | | | |
|---|---|---|---|---|
| D266,971 | S | 11/1982 | Katz et al. | |
| 4,420,103 | A * | 12/1983 | Douglass | A45F 3/04 224/907 |
| 4,830,245 | A * | 5/1989 | Arakaki | F41H 5/08 2/2.5 |
| 5,361,955 | A | 11/1994 | Gregory | |
| D354,619 | S | 1/1995 | Soukeras | |
| 5,934,527 | A * | 8/1999 | Von Neumann | A45F 3/042 224/582 |
| D425,584 | S * | 5/2000 | Hines | D2/737 |
| 6,230,950 | B1 | 5/2001 | Heetman | |
| D450,448 | S | 11/2001 | Pierce et al. | |
| 6,763,987 | B1 * | 7/2004 | Eberle | A45F 3/04 224/652 |
| 7,575,138 | B2 * | 8/2009 | Lindberg | A63C 11/025 224/652 |

(Continued)

FOREIGN PATENT DOCUMENTS

| | | |
|---|---|---|
| CA | 2518127 A1 | 3/2007 |
| CN | 305665419 | 3/2020 |

(Continued)

OTHER PUBLICATIONS

Goruck.com, visited on Apr. 3, 2019 (via Internet Archive) (Year: 2019).*

(Continued)

*Primary Examiner* — Scott T McNurlen
(74) *Attorney, Agent, or Firm* — Offit Kurman; Gregory Grissett; Tod Kupstas

(57) ABSTRACT

An embodiment of the present disclosure of a pack article that includes an internal space configured to receive a weighted exercise plate, a lumbar support member, and sternum strap for improving stability during use.

19 Claims, 8 Drawing Sheets

(56) References Cited

U.S. PATENT DOCUMENTS

| | | | | |
|---|---|---|---|---|
| D604,049 | S | 11/2009 | Chu et al. | |
| D685,440 | S * | 7/2013 | Tuttle | D21/683 |
| D690,502 | S | 10/2013 | Bergquist | |
| D692,229 | S | 10/2013 | Archambeau | |
| D733,420 | S | 7/2015 | Archambeau | |
| 9,072,365 | B1 | 7/2015 | Maneii | |
| D794,948 | S * | 8/2017 | Wright | D21/683 |
| D828,016 | S | 9/2018 | Gillespie et al. | |
| D830,053 | S | 10/2018 | Dumas | |
| 10,463,138 | B1 | 11/2019 | Boutin et al. | |
| D873,565 | S | 1/2020 | Long | |
| 10,702,047 | B1 | 7/2020 | Younan | |
| 10,799,751 | B2 * | 10/2020 | Kelly | A63B 21/4007 |
| 2005/0096199 | A1 * | 5/2005 | Egbert | A63B 21/0602 482/105 |
| 2010/0176172 | A1 | 7/2010 | Gleason, Jr. | |
| 2011/0120893 | A1 | 5/2011 | Rekuc et al. | |
| 2013/0221051 | A1 | 8/2013 | Hairston et al. | |
| 2015/0157115 | A1 | 6/2015 | Smith | |
| 2016/0235186 | A1 | 8/2016 | Chueh | |
| 2018/0154203 | A1 * | 6/2018 | Schromm | A45F 4/02 |
| 2018/0352939 | A1 | 12/2018 | Buffinton | |
| 2022/0125183 | A1 | 4/2022 | McCarthy et al. | |
| 2022/0304454 | A1 | 9/2022 | McCarthy et al. | |

FOREIGN PATENT DOCUMENTS

| | | | |
|---|---|---|---|
| CN | 307305405 | | 5/2022 |
| EP | 0328470 | A1 * | 8/1989 |
| GB | 606926 | | 8/2019 |
| JP | 2004008765 | A | 1/2004 |
| KR | 200451347 | Y1 | 12/2010 |
| WO | 2022087417 | A1 | 4/2022 |
| WO | 2022236092 | A1 | 11/2022 |

OTHER PUBLICATIONS

GORUCK Ruck Plate Explained, https://www.youtube.com/watch?v=q5VNK6SPIns, first available Apr. 29, 2015, retrieved Nov. 9, 2022, 1 pp.

GORUCK Products, https://www.goruck.com/products/ruck-plate-carrier, first available Oct. 23, 2020, retrieved Nov. 15, 2022, 8 pp.

GORUCK Murph, https://www.youtube.com/watch?v=J_xl0-d7eLQ, first available May 8, 2020, retrieved Nov. 9, 2022, 2 pp.

GORUCK, The GORUCK Rucker 2.0 First Look & Preview, All Day Ruckoff, Feb. 23, 2018, 45 pp.

GoRuck Ruck Plate Carrier 2.0 Review, https://www.youtube.com/watch?v=AyR_nbVdg_k, 1 pp.

Authorized Officer: Miki Kobayashi, International Preliminary Report on Patentability, International Patent Application PCT/US2021/056261, Report Issued Apr. 13, 2023, 9 pp.

Authorized Officer: Daniela Dinesco, International Search Report and the Written Opinion, International Patent Application PCT/US2021/056261, Report Completed Feb. 2, 2022, 11 pp.

Authorized Officer: Manuel Henry, International Search Report and the Written Opinion, International Patent Application PCT/US2022/028129, Completed Aug. 9, 2022, 13 pp.

* cited by examiner

EXERCISE ARTICLE FOR CARRYING A WEIGHTED PLATE

CROSS-REFERENCE TO RELATED APPLICATIONS

The present application claims priority to and the benefit of U.S. Provisional Patent Application No. 63/185,114, filed May 6, 2021, the contents of which are hereby incorporated in its entirety.

TECHNICAL FIELD

The present disclosure relates generally to an exercise article for carrying a weighted exercise plate.

BACKGROUND

Rucking is an exercise regimen that is used in military training protocols to build strength and endurance. A person carries a weighted bag while completing various activities, like running, push-ups, etc. Specially designed exercise articles can be worn like a backpack and also include a compartment for holding weighted plates, or nicking plates. The weighted plates can be customizable based upon user preference and the predetermined parameters of an exercise threshold established by a user.

Stability during use is important because of a wide range of upper and lower body movements involved in traditional nicking training protocols. The exercise article should carry weight but not necessarily inhibit a user's balance and agility across a wide range of body movements during use. Such a design allows a user to customize workout routines based on the desired regimen.

Conventional exercise articles often cause discomfort due to insufficient lumbar support, lack of padding, and abrasive fabrics that result in friction burns, constricted movement during exercise regimens, and injury. Thus, there is still a need for an exercise article that provides a user with improved stability.

SUMMARY

Embodiments of the present disclosure include a pack article configured to carry a weighted exercise plate. The pack article has an internal space with a width, a depth, and a height that is sized to slidingly receive therein a 10 to 45 lbs. weighted exercise plate.

An embodiment of the present disclosure includes a pack article configured to carry a weighted exercise plate. The pack article includes a base, a top spaced from the base, a front panel, a back panel, and first and second lateral sides. The front panel is coupled to the base and the top. The back panel is coupled to the base and the top. The first lateral side extends from the front panel to the back panel and from the base to the top. The second lateral side extends from the front panel to the back panel and from the base to the top, wherein the second lateral side is opposite the first lateral side. The pack article further includes an internal space defined by inner surfaces of the base, the front panel, the back panel, and the first and second lateral sides. The internal space has a width, a depth, and a height that is sized to slidingly and conformably hold therein a weighted exercise plate, such that the weighted exercise plate occupies a substantial majority of the internal space. The pack article includes a closure member coupled to at least a portion of a top of the back panel and configured to overlap a portion of the front panel to secure the weighted exercise plate in the internal space, wherein the closure member is moveable between a first position for loading the weighted exercise plate in the internal space, and a second position that secures the weighted exercise plate in the internal space. The pack article further includes shoulder straps and a sternum strap on the shoulder straps that are configured to releasably connect the shoulder straps together.

Another embodiment of the disclosure is an exercise system having a weighted exercise plate and a pack article. The weighted exercise plate has a plate width of about 8.5 to 11.5 inches, a plate depth of about 0.25 to 2 inches, and a plate height of about 9 to 18 inches. The pack article includes a base, a top spaced from the base, a front panel, a back panel, and first and second lateral sides. The front panel is coupled to the base and the top. The back panel is coupled to the base and the top. The first lateral side extends between the front panel and the back panel and from the base to the top. The second lateral side extends between the front panel and the back panel and from the base to the top. The pack article further includes an internal space defined by inner surfaces of the base, the front panel, the back panel, the first lateral side, and the second lateral side. The internal space has a width of about 9 to 12 inches, a depth of about 0.5 to 2.5 inches, and a height of about 14 to 21 inches, such that the internal space slidingly receives therein the weighted exercise plate. The pack article further includes a closure member disposed along at least a portion of a top of the back panel and configured to overlap a portion of the front panel to secure the weighted exercise plate in the internal space. The pack article further includes shoulder straps and a sternum strap disposed on the shoulder straps and adjustably connecting the shoulder straps. The sternum strap and the closure member are configured to maintain stability of the pack article and the weighted exercise plate during active movement by a user when the pack article is worn, and the sternum strap is clasped.

BRIEF DESCRIPTION OF THE DRAWINGS

The foregoing summary, as well as the following detailed description of exemplary embodiments of the present application, are better understood when read in conjunction with the appended drawings. For the purposes of illustrating the present application, there is shown in the drawings, exemplary embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 9:
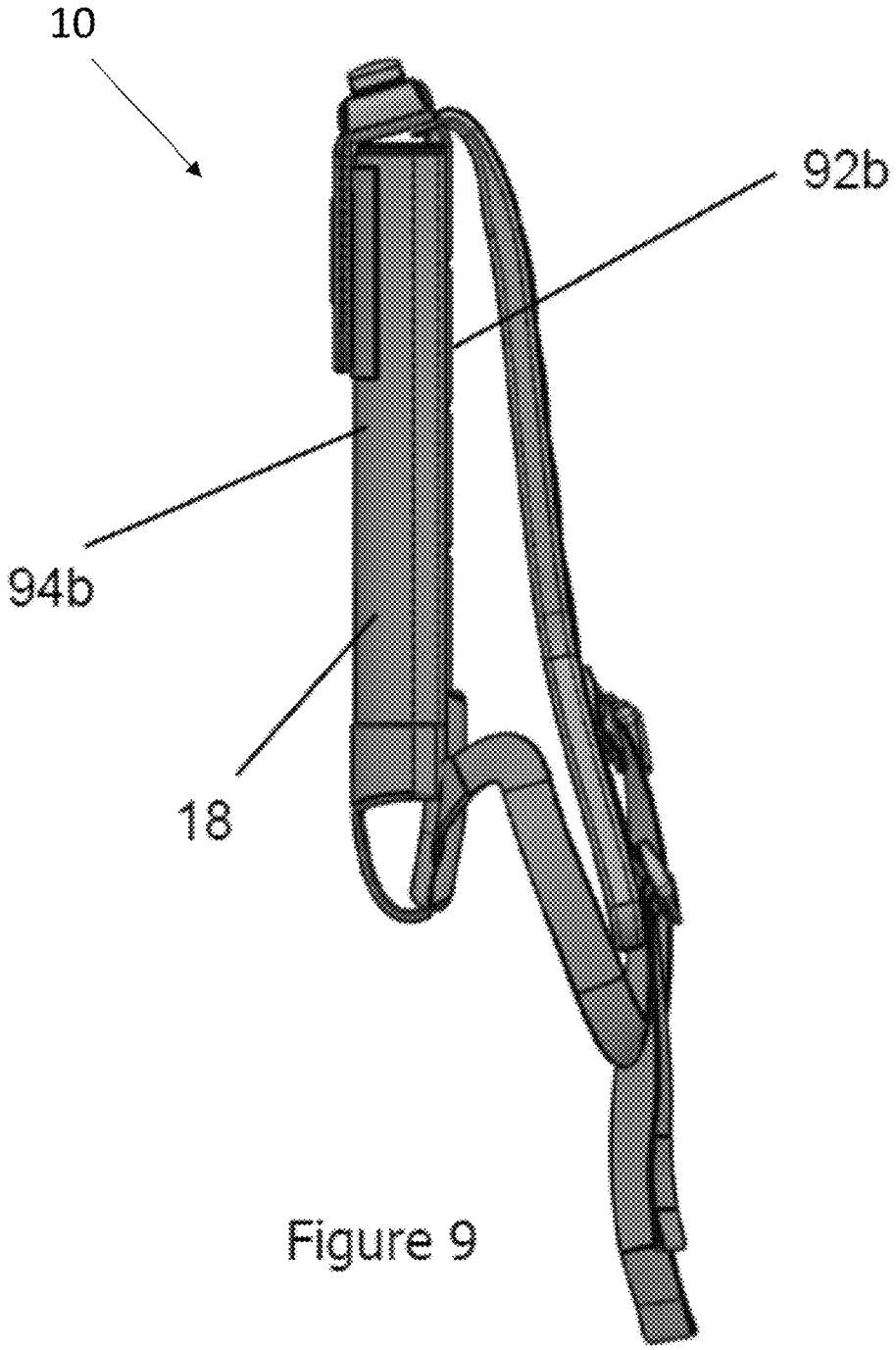
FIG. 9 is a left side view of the pack article shown in FIG. 1.
Figure 10:
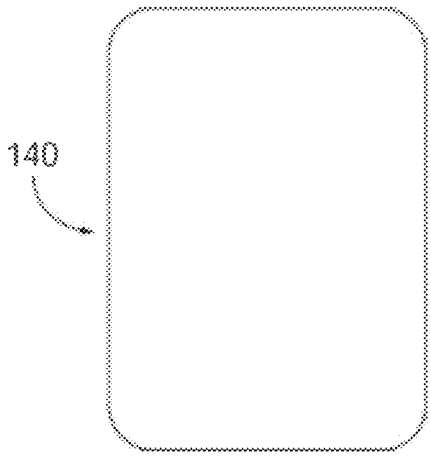
FIG. 10 is a plan view of a weighted exercise plate in accordance with an exemplary embodiment of the present disclosure.
Figure 11:
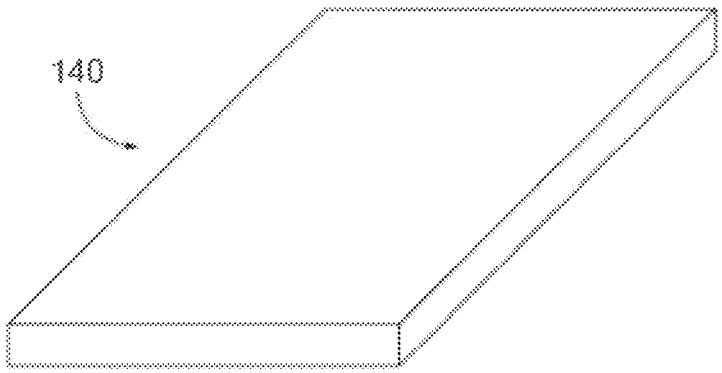
FIG. 11 is a perspective view of a weighted exercise plate shown in FIG. 10.

Embodiments of the present disclosure include a pack article 10 (FIGS. 1-9) configured to carry a weighted exercise plate 140 (FIGS. 10 and 11). The pack article 10 may be referred to as a rucking sack, rucker, or ruck sack, and is specifically configured to conformably hold a weighted exercise plate 140, e.g., nick plates, of varying weight based on user preference. The pack article 10 is designed to be carried, lifted, etc., by a user during physical activity associated with a training regimen. The pack article 10 includes a combination of features that improve stability when worn by a user, namely when the user engages in strenuous physical activity that involves a variety of upper and lower body movements. Advantageously, the pack article 10 helps provide stability and support to the user by improving distribution of loads across the user's upper and lower back during use.

Referring now to FIGS. 1-9, the pack article 10 includes a base 12, a top 14 spaced from the base 12, a first lateral side 16, a second lateral side 18 that is opposite the first lateral side 16, a front panel 40 coupled to the base 12 and the top 14, and a back panel 60 coupled to the base 12 and the top 14. The first and second lateral sides 16, 18 extend between the front panel 40 and the back panel 60 and from the base 12 to the top 14. Collectively, inner surfaces of the base 12, top 14, lateral sides 16, 18, front panel 40 and back panel 60 define an internal space 30 (FIG. 5) that is sized to receive therein a conforming and snug fit weighted exercise plate 140 (not shown in the pack article 10). More specifically, the pack article 10 is configured so that the weighted exercise plate 140, when placed inside the pack article 10, occupies a substantial majority of the internal space 30.

Referring now to FIGS. 1-9, the base 12 and top 14 are spaced apart along a height direction C, the front panel 40 and the back panel 60 are spaced apart along a depth direction B, and the lateral sides 16, 18 extend between the front panel 40 and the back panel 60 along the depth direction B. The lateral sides 16, 18 are spaced apart with respect to each other along a lateral (or width) direction A. Accordingly, the height direction C is substantially perpendicular to the depth direction B and lateral direction A. The orthogonal directions A, B, and C are used in the present disclosure only for illustrative purposes to aid in clarifying the relative positions of components of the pack article 10.

Figure 7:
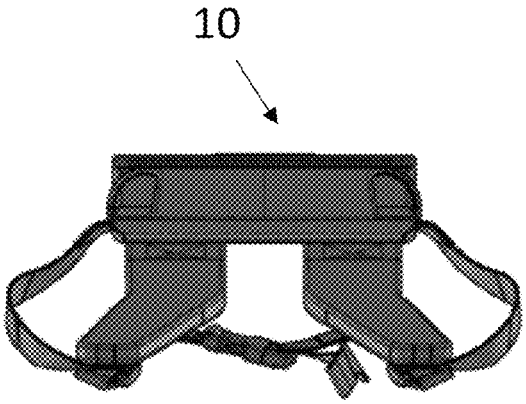
FIG. 7 is a bottom plan view of the pack article shown in FIG. 1.

As shown in FIG. 7, the base 12 of the pack article 10 includes opposed inner and outer edges and opposed sides (not numbered) that extend between the opposed inner and outer edges (not numbered). The base 12 is preferably comprised of durable woven fabrics that may encase a cushion member, e.g., a foam, felt, batting or other composite material.

Figure 8:
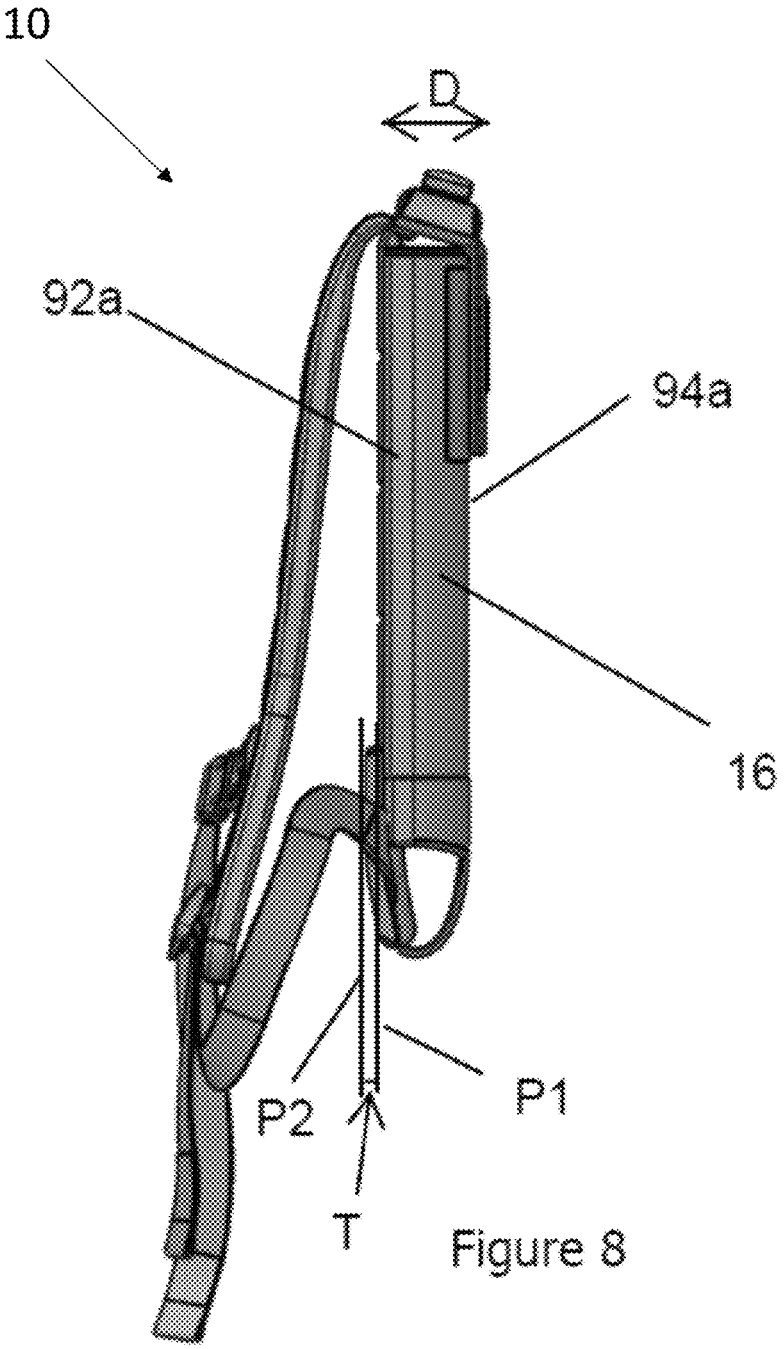
FIG. 8 is a right side view of the pack article shown in FIG. 1.

As shown in FIGS. 8 and 9, the lateral sides 16, 18 respectively include forward and rearward edges. Specifically, lateral side 16 includes a forward edge 94*a* coupled to the base 12 and a rearward edge 92*a* coupled to the base 12. Similarly, lateral side 18 includes a forward edge 94*b* coupled to the base 12 and a rearward edge 92*b* coupled to the base 12. It is to be understood that the lateral sides 16, 18 and the base 12 may be of unitary construction. The lateral sides 16, 18 are preferably comprised of durable woven fabrics that may optionally encase a cushion or foam member.

Figure 1:
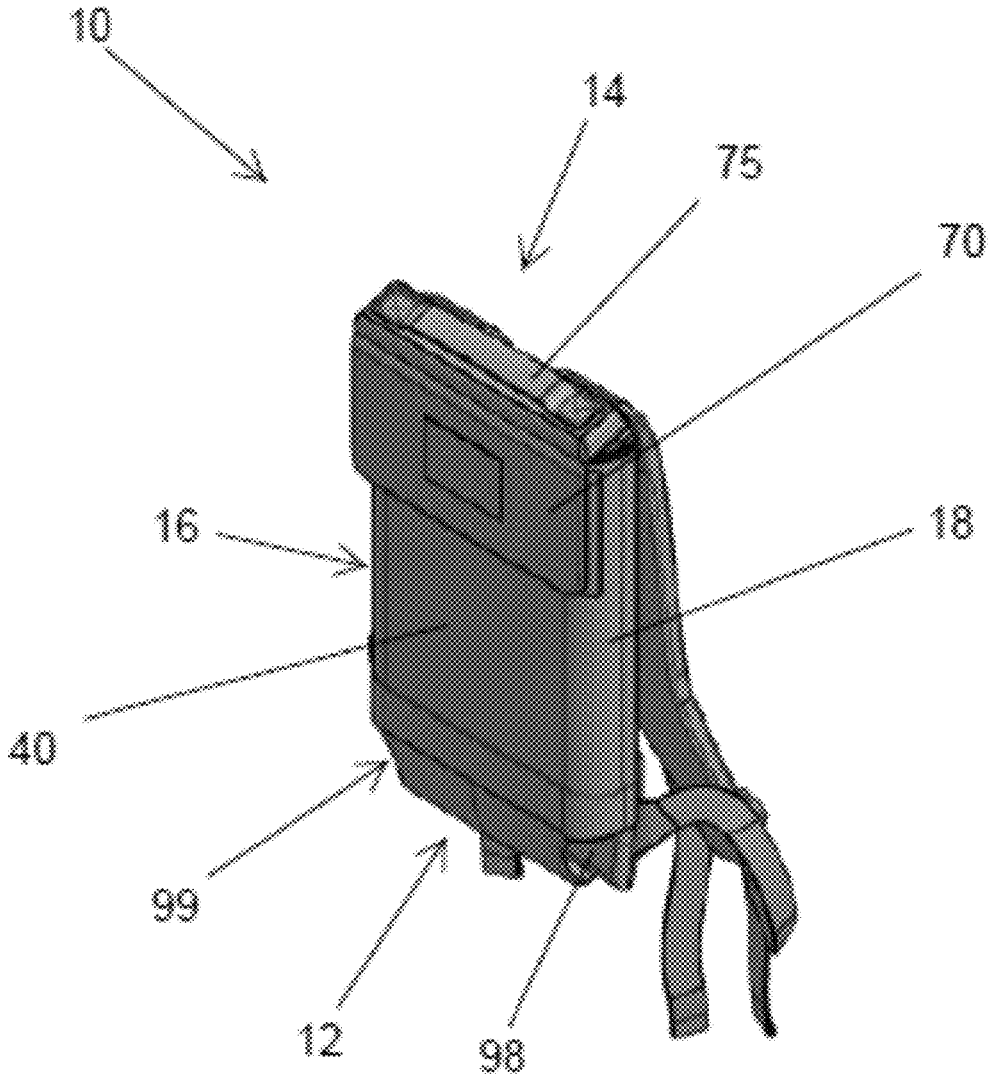
FIG. 1 is a top front perspective view of a pack article in accordance with an exemplary embodiment of the present disclosure.
Figure 3:
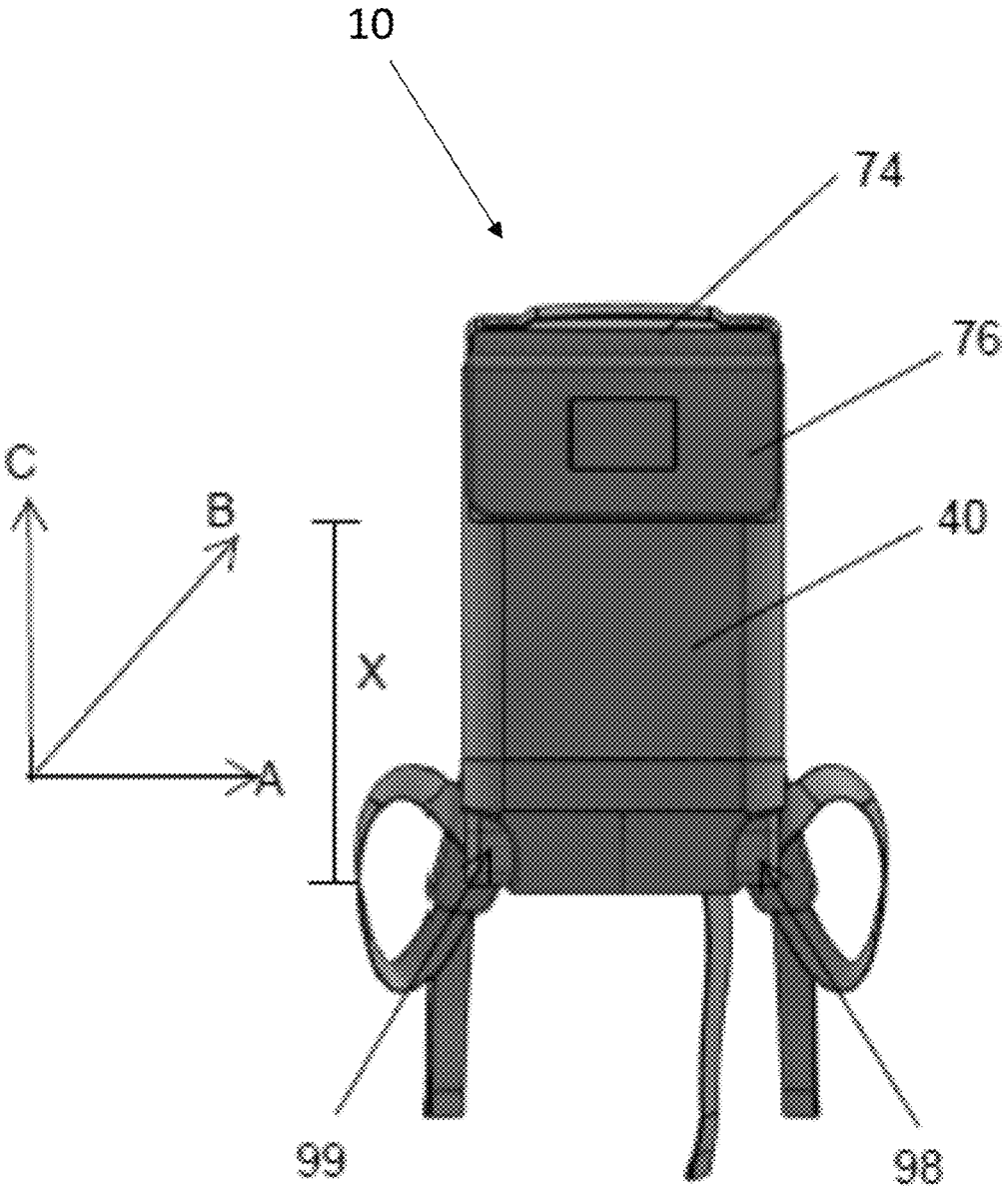
FIG. 3 is a front view of the pack article shown in FIG. 1.

Referring now to FIGS. 1 and 3, the front panel 40 is coupled to the base 12 and removably coupled to the top 14 via the closure member 70, as further discussed below. The front panel 40 is preferably comprised of durable woven fabrics and may include high tenacity yarns to form the woven fabrics.

Figure 2:
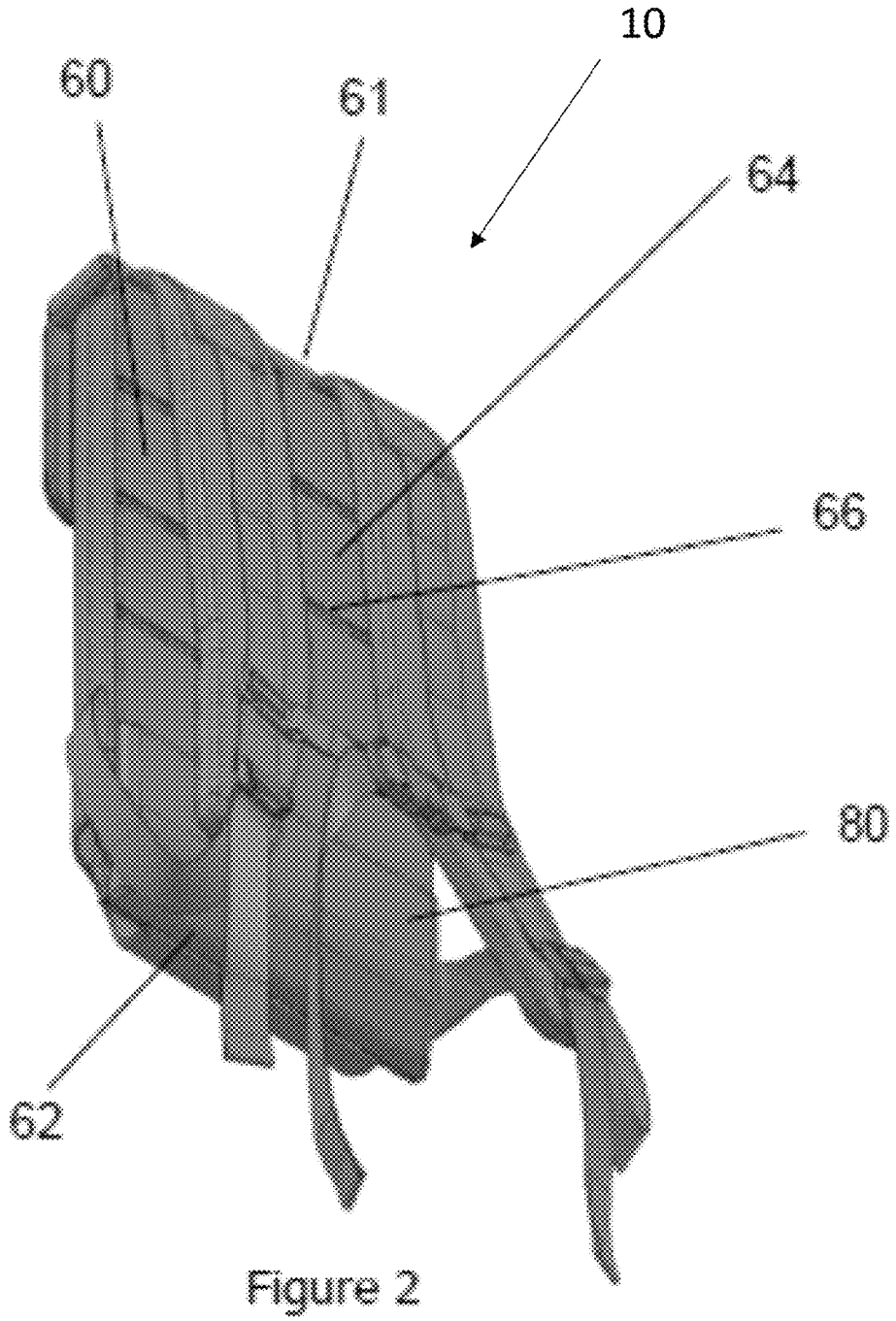
FIG. 2 is a bottom rear perspective view of the pack article shown in FIG. 1.
Figure 4:
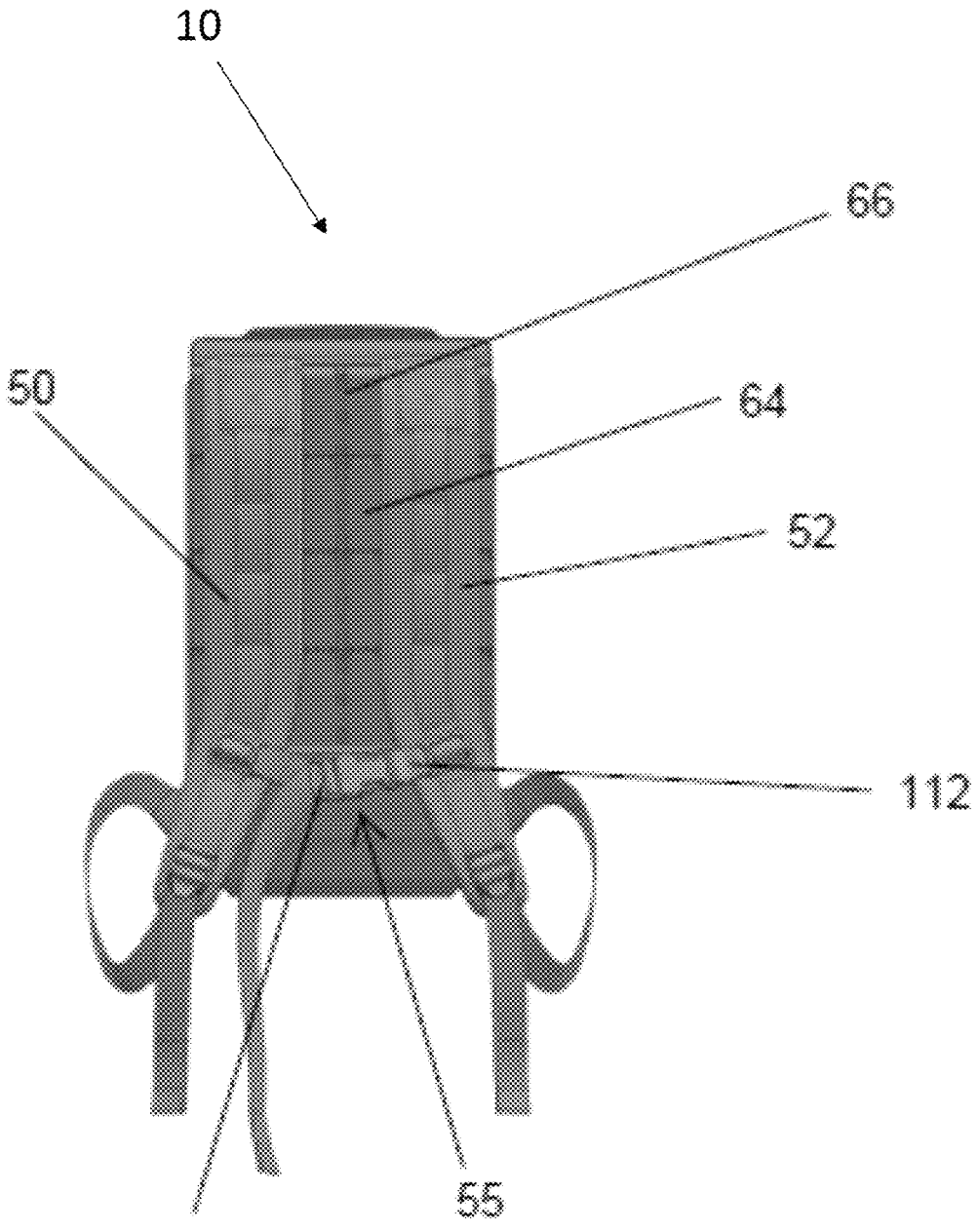
FIG. 4 is a rear view of the pack article shown in FIG. 1.

Referring now to FIGS. 2 and 4, the back panel 60 is coupled to the base 12, the top 14, and the lateral sides 16, 18. Specifically, the back panel 60 has a bottom edge 62 coupled to the base 12, a top edge 61 opposite the bottom edge 62 that is coupled to the top 14. The back panel 60 is preferably comprised of durable woven fabrics and may include high tenacity yarns to form the woven fabrics.

Referring now to FIGS. 2, 4, 8 and 9, the pack article 10 includes a plurality of pad members 64 and a lumbar support member 80 disposed along the back panel 60. Specifically, the lumbar support member 80 is located between the plurality of pad members 64 disposed along the back panel 60 at a location adjacent to the base 12 and is positioned to support a user's lower back when the pack article 10 is worn. The back panel 60 may include a plurality of encased layers that include one or more cushion elements (not shown), which form and define the plurality of pad members 64 and the lumbar support member 80. The cushion elements may comprise an open cell foam, closed cell foam or another compressible and resilient material suitable to provide support. In accordance with an embodiment, the lumbar support member 80 comprises a cross-linked polyolefin foam and the plurality of pad members 64 comprise cross-linked polyolefin foam.

As shown in FIGS. 2 and 4, the back panel 60 includes a plurality of stitch lines 66 that define a size and shape of the plurality of pad members 64 and the lumbar support member 80. The plurality of pad members 64 extend across an entirety of the back panel 60, namely between the top 14 and the base 12 and between lateral side 16 and lateral side 18. In other words, the plurality of pad members 64 are located between the lumbar support member and the top. The lumbar support member 80 traverses an entirety of a width of the back panel 60 between the lateral side 16 and lateral side 18, and between about 10% and 25% of a height of the back panel 60. Alternatively, the back panel 60 may be formulated with a flat surface instead of the plurality of pad members 64.

As shown in FIG. 8, the lumbar support member 80 has a thickness that is greater than a thickness of any one of the plurality of pad members 64 disposed along the back panel 60. That is, the lumbar support member 80 projects outwardly relative to the plurality of pad members 64 sufficient to allow the lumbar support member 80 to contact the user's lower back while allowing the plurality of pad members 64 to contact the user's upper back. For purposes of clarity, the thickness T refers to the difference between the elevation of the lumbar support member 80 and the elevation of the plurality of pad members 64. In this regard, the plurality of pad members 64 define a plurality of planar contact surfaces (not numbered) that lie along a first plane P1, and the lumbar support member 80 defines a contact surface (not numbered) that lies along a second plane P2. The thickness T is the distance between planes P1 and plane P2 (along a perpendicular line that intersects both planes P1, P2). In the embodiment shown, the thickness T is between about 0.25 inches to 0.5 inches. In one example, the thickness T is 0.25 inches. In another example, the thickness T is 0.3 inches. In yet another example, the thickness T is 0.375 inches, in another example, the thickness is 0.40 inches. In another example, the thickness T is 0.5 inches. The thickness T may fall outside these ranges. However, a thickness T between 0.25 and 0.50 inches is particularly useful when combined with other stability features, such as a sternum strap.

As shown in FIGS. 2, 4, 8 and 9, the lumbar support member 80 is substantially rectangular and, as previously discussed, the lumbar support member 80 extends across the entirety of the width of the back panel 60 between the respective lateral sides 16, 18. However, it is to be understood that the lumbar support member 80 may have other shapes and configurations suitable for its intended purpose of providing lower back support to the user. In accordance with an embodiment, the lumbar support member 80 may also be of modular construction and formed from a plurality of lumbar support member segments.

Referring now to FIGS. 1-5, the pack article 10 also includes a closure member 70. As shown, the closure member 70 is located along at least a portion of the top of the back panel 60 and is configured to overlap a portion of the front panel 40 to secure the weighted exercise plate in the internal space 30. In this manner, the closure member 70 is secured to the back panel 60 and is moveable between a first position to open access to the internal space 30 and a second position to close access to the internal space 30.

As shown, the closure member 70 includes a first panel 74 circumscribing an upper opening of the internal space 30, and a second panel 76 that overlaps an upper portion of the front panel 40. That is, the first panel 74 is spaced apart from the base 12 and lies adjacent the top edge 61 of the back panel 60. As shown in FIG. 3, a bottom end of the second panel 76 is spaced apart from the base 12 a distance X that is between 20% and 35% of a total height of the back panel 60. In accordance with an embodiment, the first panel 74 has a thickness that is greater than a thickness of the second panel 76.

The closure member 70 is moveable between a first position and a second position for removably securing a weighted exercise plate into the internal space 30 of the pack article 10. Specifically, the closure member 70 is moveable between a first position (FIG. 5) for loading the weighted exercise plate in the internal space 30, and a second position (FIG. 1) for securing the weighted exercise plate in the internal space 30.

Figure 5:
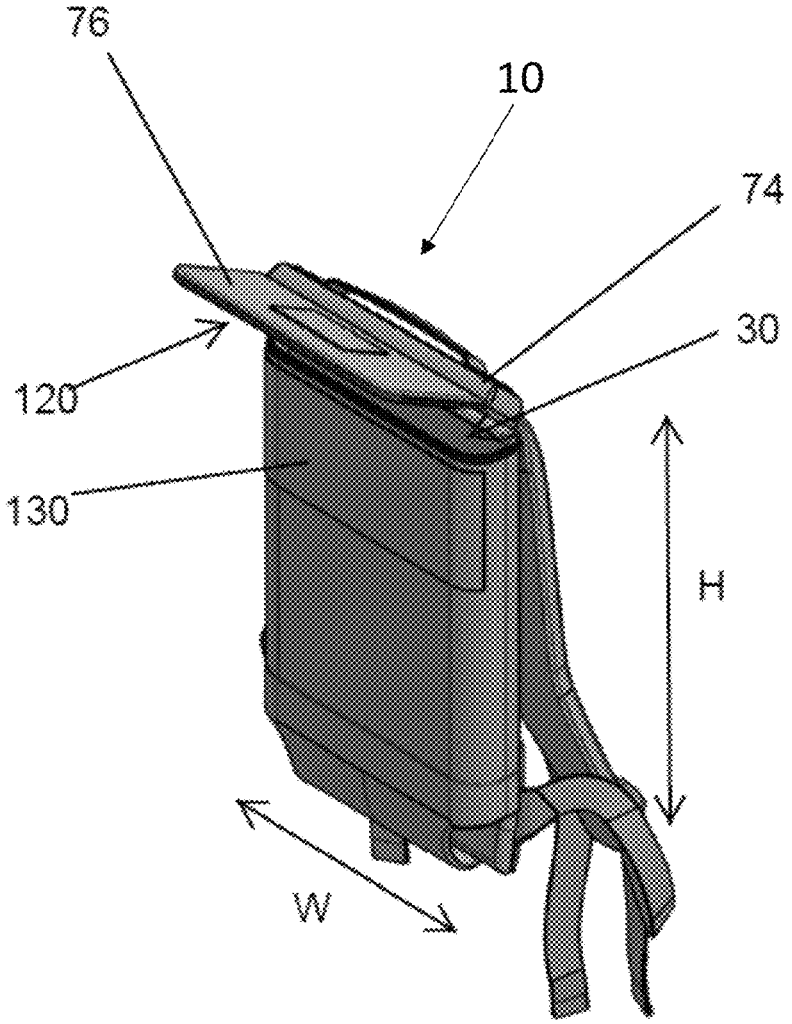
FIG. 5 is a top front perspective view of the pack article shown in FIG. 1 with the closure member in an open position.
Figure 6:
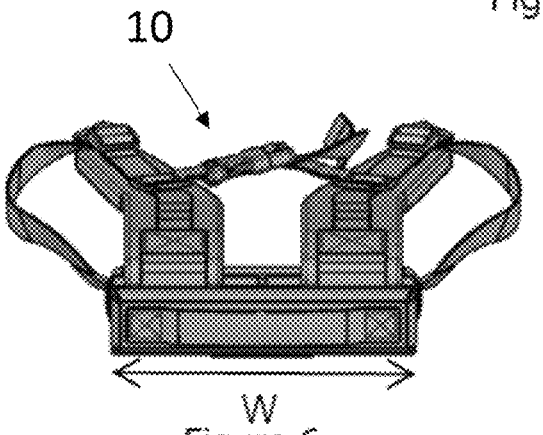
FIG. 6 is a top plan view of the pack article shown in FIG. 1.

As shown in FIG. 5, the pack article 10 includes at least one fastener member 120, 130. In the example shown, there is included a first fastener member 120 and a second fastener member 130, each of which are configured to secure the closure member 70 to the front panel 40. More specifically, the first fastener member 120 is positioned on the closure member 70 and the second fastener member 130 is positioned on the front panel 40. In use, the first fastener member 120 is configured to selectively engage to the second fastener member 130 to gain access to the internal space 30 for loading and unloading the weighted exercise plate. The fastener members may be hook and loop fasteners. However, other fastener types may be used.

Referring now to FIG. 5, the internal space 30 of the pack article 10 is sized to conform to the weighted exercise plate so that its movement in the pack article 10 in use is minimized. In particular, the internal space 30 is defined by inner surfaces of the base 12, the front panel 40, the back panel 60 and the lateral sides 16, 18. That is, the internal space 30 has a width, a depth, and a height that is sized to slidingly receive therein a weighted exercise plate (not shown). More specifically, the internal space 30 has an overall width W that extends from an inner surface of the first lateral side 16 to the inner surface of the second lateral side 18. The internal space 30 has an overall height H that extends from the inner surface of the base 12 to the inner surface of the closure member 70 when closed (or top 14). The height H is perpendicular to the overall width W. The internal space also has an overall depth D that extends from the inner surface of the back panel 60 to the inner surface of the front panel 40. The overall depth D is substantially perpendicular to the overall height H and the overall width W. In one exemplary embodiment, the internal space 30 has an overall width W between 9.0 and 12.0 inches, an overall height H between 14.0 inches and 21.0 inches, and an overall depth D between 0.5 inches and 2.5 inches. With these dimensions, the internal space 30 is sized and configured so as to be sufficient to receive a weighted exercise plate therein, such as the Ruck Plate®, such that the weighted exercise plate occupies a substantial entirety of the internal space 30. The Ruck Plate Carrier™ is purpose-built for weighted PT and has an elevated Ruck Plate® pocket that will securely fit a 20 LB or 30 LB Ruck Plate®. Alternatively, it is to be understood that the weighted exercise plate can be between 10 lbs. and 45 lbs.

In accordance with an embodiment of the exemplary embodiment, a ratio of the height H to the width W for the internal space 30 ranges from about 1.55:1 to 1.75:1. In alternative embodiments, the ratio of the heigh H to the width W can alternatively be less than 1.55:1 or greater than 1.75:1. In accordance with yet another aspect of the exemplary embodiment, a ratio of the height H to the depth D for the internal space 30 ranges from about 28:1 to 8:1, but can alternatively be less than 8:1 or greater than 28:1.

The pack article 10 includes pair of ports 98, 99 disposed along the base 12 and first and second lateral sides 16, 18 that are open to the internal space 30. The pair of ports 98, 99 allow a user to visually determine whether a weighted exercise plate has been placed in the internal space from a distance. Additionally, the ports 98, 99 allow for the draining of fluid or other debris while the pack article is in use. Advantageously, the ports 98, 99 prevent the accumulation of sweat, water, and other particles that may become stagnant and confined in the internal space 30 over time.

As shown in FIG. 1, the pack article 10 optionally includes a handle 75 extending across an upper portion of the closure member 70. The handle 75 can be used to facilitate grabbing the pack article 10. Though not shown, it is to be understood that the pack article 10 may include additional handles or gripping members extending across the base 12 and/or lateral sides 16, 18. Alternatively, the pack article 10 may not include a handle.

The pack article 10 includes a pair of shoulder straps 50, 52 to secure the pack article 10 to a user. As shown in FIGS. 1-9, the shoulder straps 50, 52 extend between the top edge 61 and bottom edge 62 of the back panel 60 and partially overlay the back panel 60. The shoulder straps 50, 52 may include additional padding to carry heavier loads (e.g., heavier weighted exercise plates) more comfortably.

The pack article 10 also includes a sternum strap 55 that is removably coupled to the shoulder straps 50, 52 and configured to be selectively clasped as needed to facilitate improved stability. The sternum strap 55 includes a first strap portion (not shown) removably coupled to shoulder strap 50 and a second strap portion (not shown) removably coupled to shoulder strap 52. The sternum strap 55 further includes a first clasp member 110 coupled to shoulder strap 50 and a second clasp member 112 coupled to shoulder strap 52, wherein the first and second clasp members 110, 112 are releasably clasped to one another based on user preference. The sternum strap 55 can be repositioned along different loops coupled to the shoulder straps 50, 52 to adjust the positioning of the shoulder straps relative to the user.

The shoulder straps 50, 52 secure the pack article 10 to the user. These shoulder straps 50, 52 are adjustable and/or come in different size configurations. In addition, the sternum strap 55 disposed on the shoulder straps and connecting the shoulder straps is also adjustable based on user preference. For instance, the sternum strap may be configured to slide upward or downward along rails on the shoulder strap to optimize the position of the sternum strap on the user. In accordance with an embodiment, the sternum strap 55 is positioned a distance that is closer to the top 14 than to the base 12.

The shoulder straps 50, 52 may have varying sizes depending on the user. For example, a small shoulder strap can have a length of about 14 to 19 inches and a width of about 2 to 3 inches. In an example, the shoulder strap has a length of about 15.9 inches and a width of about 2.4 inches. The shoulder strap may also have a length of about 16.8 inches and a width of about 2.8 inches. A larger shoulder strap may have a length of about 18.7 inches and a width of about 2.8 inches. Similarly, the sternum strap 55 can have a length of about 7.5 inches and a width of about 1 inch. It is to be understood that the dimensions of the shoulder straps and the sternum strap may vary outside of the dimensions discussed above based on user need and preference.

FIGS. 10 and 11 illustrate an exemplary weighted exercise plate 140 for insertion into the internal space 30. That is, the weighted exercise plate 140 has a width, height and depth (width, height and depth not shown) selected to slidingly fit within the internal space 30 without substantial movement therein. In other words, the dimensions of the weighted exercise plate 140 are similar and conform to the dimensions of the internal space 30 discussed above. As such, the plate width, plate height and plate depth form a plate volume that substantially conforms to the internal space. The weighted exercise plate 140 may be, for example, a 10 lb., 15 lb., 20 lb., 25 lb., 30 lb., 35 lb., 40 lb., or 45 lb. exercise plate. In accordance with an embodiment, the weighted exercise plate has a plate width of about 8.5 to 11.5 inches, a plate depth of about 0.25 to 2 inches, and a plate height of about 9 to 18 inches.

It is to be understood that the contents of the internal space are not limited to the weighted exercise plate 140. For example, a plurality of weighted exercise plates or other weighted materials may also be placed within the internal space to facilitate an exercise regimen tailored to the specific needs of the user or wearer of the pack article. In accordance with an embodiment, the weighted exercise plate 140 may include a handle opening (not shown) for facilitating removal of the weighted exercise plate from the internal space 30.

The pack article 10, which may be referred to as ruck plate carrier, is the most streamlined and efficient way to add weight to user workouts. The pack article includes more padding, ergonomic lumbar support and an all-new, less abrasive fabric used on the back panel and underside of the shoulder straps to minimize friction burn. Every pack article also comes with a wider and tougher training sternum strap to better disperse heavy loads. Features of the pack article include but are not limited to, lumbar padding to support the natural curve of a user's back, Ruck Plate® compatible, shoulder straps are extra padded to carry heavier loads more comfortably, padded top lid protects during dynamic movements, and a durable ballistic nylon bottom panel.

As discussed above, the pack article 10 is formed from heavy duty woven fabric materials. The outer panels are made of woven fabrics that may include nylon continuous filament yarns. In one example, the woven fabrics of the outer panels are formed from 1000D CORDURA® yarns. The back panel and shoulder strap underside materials are formed of woven fabrics made with high tenacity continuous filament yarn. For example, the back panel and should strap yarns may be 210D HT (High Tenacity) CORDURA® yarns. The base is a woven fabric made with nylon yarns. In one example, the base is made of 1050D Ballistic CORDURA® yarns. The lumbar support material may be foam padding. In one example, the lumbar support material is an ethylene-vinyl acetate (EVA) closed cell foam. Embodiments of the pack article fit high and tight on torso, forcing core muscle engagement. The pack article is also stable through a range of movements and exercises. The pack article is designed to allow for interchange of different weight plates, such as Ruck Plate™.

When in use, the combination of the lumbar support member 80, the sternum strap 55 and the closure member 70 are configured to maintain stability of the pack article and the weighted exercise article during active movement by the user when the pack article is worn and the sternum strap 55 is clasped.

Wherever possible, the same or like reference numbers are used throughout the drawings to refer to the same or like features. It should be noted that the drawings are in simplified schematic form and are not drawn to precise scale. Certain terminology is used in the description is for convenience only and is not limiting. Directional terms such as top, bottom, left, right, above, below and diagonal, are used with respect to the accompanying drawings. The words "inwardly" and "outwardly" refer to directions toward and away from, respectively, the geometric center of the identified element and designated parts thereof. Such directional terms used in conjunction with the following description of the drawings should not be construed to limit the scope of the present disclosure in any manner not explicitly set forth. Additionally, the term "a," as used in the specification, means "at least one." The terminology includes the words above specifically mentioned, derivatives thereof, and words of similar import.

"Substantially" as used herein shall mean considerable in extent, largely but not wholly that which is specified, or an appropriate variation therefrom as is acceptable within the field of art. "Exemplary" as used herein shall mean serving as an example.

"About" as used herein when referring to a measurable value such as an amount, a temporal duration, and the like, is meant to encompass variations of ±20%, ±10%, ±5%, ±1%, or ±0.1% from the specified value, as such variations are appropriate.

Throughout this disclosure, various embodiments of the present invention can be presented in a range format. It should be understood that the description in range format is merely for convenience and brevity and should not be construed as an inflexible limitation on the scope of the present invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of exemplary embodiments may be combined in any suitable manner in one or more embodiments. One skilled in the art will recognize, in light of the description herein, that the exemplary embodiments can be practiced without one or more of the specific features or advantages of a particular embodiment. In other instances, additional features and advantages may be recognized in certain embodiments that may not be present in all embodiments of the present disclosure.

While the disclosure is described herein, using a limited number of embodiments, these specific embodiments are not intended to limit the scope of the disclosure as otherwise described and claimed herein. The precise arrangement of various elements and order of the steps of articles and methods described herein are not to be considered limiting. As such, the method can be implemented in any order as desired.

The invention claimed is:

1. A pack article configured to carry a weighted exercise plate, comprising:

a base;

a top spaced from the base;

a front panel coupled to the base and the top;

a back panel coupled to the base and the top;

a first lateral side that extends from the front panel to the back panel and from the base to the top;

a second lateral side that extends from the front panel to the back panel and from the base to the top, wherein the second lateral side is opposite the first lateral side;

an internal space defined by inner surfaces of the base, the front panel, the back panel, and the first and second lateral sides, the internal space having a width, a depth, and a height that is sized to slidingly and conformably hold therein the weighted exercise plate, such that the weighted exercise plate occupies a substantial majority of the internal space;

a closure member coupled to at least a portion of a top of the back panel, the closure member being configured to overlap a portion of the front panel to secure the weighted exercise plate in the internal space, wherein the closure member is moveable between a first position for loading the weighted exercise plate in the internal space, and a second position that secures the weighted exercise plate in the internal space;

a plurality of pad members disposed along the back panel and adjacent to a top edge of the back panel, the plurality of pad members each defining a planar contact surface that lies along a first common plane;

a lumbar support member located between the plurality of pad members and the base, the lumbar support member defining a second planar contact surface that lies along a second plane spaced from the first common plane;

shoulder straps;

a sternum strap on the shoulder straps that are configured to releasably connect the shoulder straps together; and further comprising a pair of ports disposed along the base and the first and second lateral sides where corner portions of the pack article would be, wherein the pair of ports permit visual determination of a presence of the weighted exercise plate from a location external to the pack article, wherein the pair of ports are configured to allow fluid to pass therethrough.

2. The pack article of claim 1, wherein the lumbar support member, the sternum strap and the closure member are configured to maintain stability of the pack article and the weighted exercise plate during active movement by a user when the pack article is worn, and the sternum strap is clasped.

3. The pack article of claim 1, further comprising at least one fastener member configured to secure the closure member to the front panel.

4. The pack article of claim 3, wherein the at least one fastener member includes a first fastener member on the closure member and a second fastener member on the front panel, the first fastener member is configured to engage to the second fastener member to secure the weighted exercise plate in the internal space.

5. The pack article of claim 1, wherein the weighted exercise plate has a plate width, a plate height and a plate depth that forms a plate volume that substantially conforms to the internal space.

6. The pack article of claim 1, wherein the closure member includes a handle.

7. The pack article of claim 1, wherein the closure member includes a first panel circumscribing an upper opening of the internal space, and a second panel that overlaps an upper portion of the front panel.

8. The pack article of claim 7, wherein the first panel has a thickness that is greater than a thickness of the second panel.

9. The pack article of claim 1, wherein a ratio of the height of the internal space to the width of the internal space is about 1.7:1, and a ratio of the height of the internal space to the depth of the internal space is about 18:1.

10. The pack article of claim 1, wherein the sternum strap is positioned a first distance that extends from the top to the sternum strap and a second distance from the sternum strap to the base, wherein the first distance is less than the second distance.

11. The pack article of claim 1, wherein the lumbar support member traverses an entirety of a width of the back panel, and between 10% and 25% of a height of the back panel; and the plurality of pad members is located between the lumbar support member and the top, wherein the lumbar support member has a thickness that is greater than a thickness of any one of the plurality of pad members.

12. The pack article of claim 11, wherein the back panel includes a plurality of stitch lines that define a size and shape of the plurality of pad members and the lumbar support member.

13. The pack article of claim 1, wherein the width is between about 8 to 11 inches, the depth is between about 0.5 to 2.5 inches, and the height is between about 14 to 21 inches, such that the internal space is sized to slidingly receive therein the weighted exercise plate having a plate width of about 8.5 to 11.5 inches, a plate depth of about 0.25 to 2 inches, and a plate height of about 9 to 18 inches.

14. The pack article of claim 1, wherein the lumbar support member is substantially rectangular.

15. An exercise system, comprising:

a weighted exercise plate having a plate width of about 8.5 to 11.5 inches, a plate depth of about 0.25 to 2 inches, and a plate height of about 9 to 18 inches; and a pack article having a base, a top spaced from the base, a front panel coupled to the base and the top, a back panel coupled to the base and the top, first lateral side that extends between the front panel and the back panel and from the base to the top, a second lateral side that extends between the front panel and the back panel and from the base to the top, and an internal space defined by inner surfaces of the base, the front panel, the back panel, the first lateral side, and the second lateral side, wherein the internal space has a width of about 9 to 12 inches, a depth of about 0.5 to 2.5 inches, and a height of about 14 to 21 inches, such that the internal space slidingly receives therein the weighted exercise plate, the pack article further including a closure member disposed along at least a portion of a top of the back panel and configured to overlap a portion of the front panel to secure the weighted exercise plate in the internal space, a plurality of pad members disposed along the back panel and adjacent to a top edge of the back panel, a lumbar support member located between the plurality of pad members and the base, shoulder straps, and a sternum strap disposed on the shoulder straps and adjustably connecting the shoulder straps, wherein the plurality of pad members each define a planar contact surface that lies along a first common plane, and the lumbar support member defines a second planar contact surface that lies along a second plane spaced from the first common plane, wherein the sternum strap and the closure member are configured to maintain stability of the pack article and the weighted exercise plate during active movement by a user when the pack article is worn, and the sternum strap is clasped; and wherein the pack article comprises a pair of ports disposed along the base and the first and second lateral sides where corner portions of the pack article would be, wherein the pair of ports permit visual determination of a presence of the weighted exercise plate from a location external to the pack article, wherein the pair of ports are configured to allow fluid to pass therethrough.

16. The exercise system of claim 15, wherein a ratio of the height of the internal space to the width of the internal space is about 1.7:1, and a ratio of the height of the internal space to the depth of the internal space is about 18:1.

17. The exercise system of claim 15, wherein the sternum strap is positioned a first distance that extends from the top to the sternum strap and a second distance from the sternum strap to the base, wherein the first distance is less than the second distance.

18. The exercise system of claim 15, wherein the weighted exercise plate has a weight between about 10 lbs. and about 45 lbs.

19. The exercise system of claim 15, wherein the lumbar support member traverses an entirety of a width of the back panel, and between 10% and 25% of a height of the back panel; and wherein the lumbar support member has a thickness that is greater than a thickness of any one of the plurality of pad members.

* * * * *